US005487226A

United States Patent [19]

Hoover

[11] Patent Number: 5,487,226

[45] Date of Patent: Jan. 30, 1996

[54] MANURE DRYING SYSTEM AND RELATED METHOD

[75] Inventor: Don R. Hoover, Milford, Ind.

[73] Assignee: CTB, Inc., Milford, Ind.

[21] Appl. No.: 296,693

[22] Filed: Aug. 26, 1994

[51] Int. Cl.[6] ..... F26B 3/00

[52] U.S. Cl. ..... 34/503; 34/167; 34/168; 34/214

[58] Field of Search ..... 34/165, 167, 168, 34/170, 172, 175, 176, 224, 214, 236, 428, 429, 498, 500, 501, 506, 510, 503; 198/525, 836.1

[56] References Cited

U.S. PATENT DOCUMENTS

| | | | |
|---|---|---|---|
| 2,486,903 | 11/1949 | Wormell | 34/500 |
| 4,242,809 | 1/1981 | Elder | 34/498 |
| 4,445,282 | 5/1984 | Heinemans | 34/168 |
| 4,678,076 | 7/1987 | Nenakhov et al. | 198/525 |
| 5,097,749 | 3/1992 | Smith, Jr. | 454/251 |
| 5,145,460 | 9/1992 | Smith, Jr. | 454/253 |

*Primary Examiner*—Henry A. Bennett
*Assistant Examiner*—Susanne C. Tinker
*Attorney, Agent, or Firm*—Trexler, Bushnell, Giangiorgi & Blackstone, Ltd.

[57] ABSTRACT

A manure drying system for reducing the moisture content in manure collected in an animal husbandry operation, and a method of carrying out the manure drying process. The system and method include providing an animal confinement facility having a ventilation system operating within the facility which causes an air flow. Accumulation apparatus for collecting and selectively holding manure produced by the animals and channeling apparatus for directing at least some part of the air flow produced within the facility onto the manure collected by the accumulation apparatus are also provided. The use of the apparatus and method cause a significant reduction in the moisture content of the manure accumulated and facilitate handling and disposal operations.

20 Claims, 4 Drawing Sheets

MANURE DRYING SYSTEM AND RELATED METHOD

BACKGROUND OF THE INVENTION a. Field of the Invention

In general, the present invention relates to a system for drying manure, and an associated method of use. More particularly, the present invention concerns the use of an apparatus within a ventilated animal confinement facility for accumulating and reducing the moisture content in animal manure by directing at least some portion of the ventilation onto the manure.

b. Description of Related Prior Art

Animal manure handling and disposal presents ever-increasing problems to the animal husbandry industry. For example, composting equipment usually will not operate effectively unless the moisture content in the animal manure is first reduced to an acceptable level, which takes far too much time under normal conditions to occur naturally.

The option of hauling wet manure by truck to remote locations for disposal does not present an attractive alternative. Large amounts of water in the manure add significant weight to the load and raise associated fuel costs. Much like the developing shortage of landfill space across the country, farmland isolated from housing which is needed for manure disposal is also becoming very scarce. As a result, trucks hauling manure must travel greater distances to disposal locations which also adds significantly to fuel bills.

Health concerns connected with flies, rodents, bacteria growth (such as salmonella), dust, etc. also must be addressed when handling and disposing of animal manure. Such concerns are the subject of present and proposed state and federal legislation attempting to minimize these problems.

Known prior art handling and disposal systems for animal manure fall far short of effectively solving these and other related problems.

OBJECTS AND SUMMARY OF THE INVENTION

It is a general objective of the present invention to reduce the rising number of problems associated with the handling and disposal of animal manure.

It is an associated objective of the present invention to provide a manure drying system for more rapidly reducing the moisture content in animal manure.

It is a related objective of the present invention to provide a method for expeditiously decreasing the moisture in animal manure to facilitate handling and disposal.

Other objects and advantages of the invention will become apparent upon reading the following detailed description, and upon reference to the drawings. Throughout the description, like referenced numerals refer to like parts.

Summarily stated, the present invention relates to a manure drying system for reducing the moisture content in animal manure, the drying system comprising an animal confinement facility having a ventilation system causing an air flow within the confinement facility, accumulation apparatus for collecting and selectively holding the animal manure produced within the facility, and channeling apparatus for directing at least some of the air flow produced within the facility onto the manure collected by the accumulation apparatus.

BRIEF DESCRIPTION OF THE DRAWINGS

The features of the present invention which are believed to be novel are set forth with particularity in the appended claims. The organization and manner of operation of the invention together with further objects and advantages thereof may best be understood by reference to the following description taken in connection with the accompanying drawings, in which:

DETAILED DESCRIPTION OF THE PREFERRED EMBODIMENT

While the invention will be described in connection with a preferred embodiment, it will be understood that it is not intended to limit the invention to that embodiment. On the contrary, it is intended to cover all alternatives, modifications or equivalents as may be included within the spirit and scope of the invention.

Figure 1:
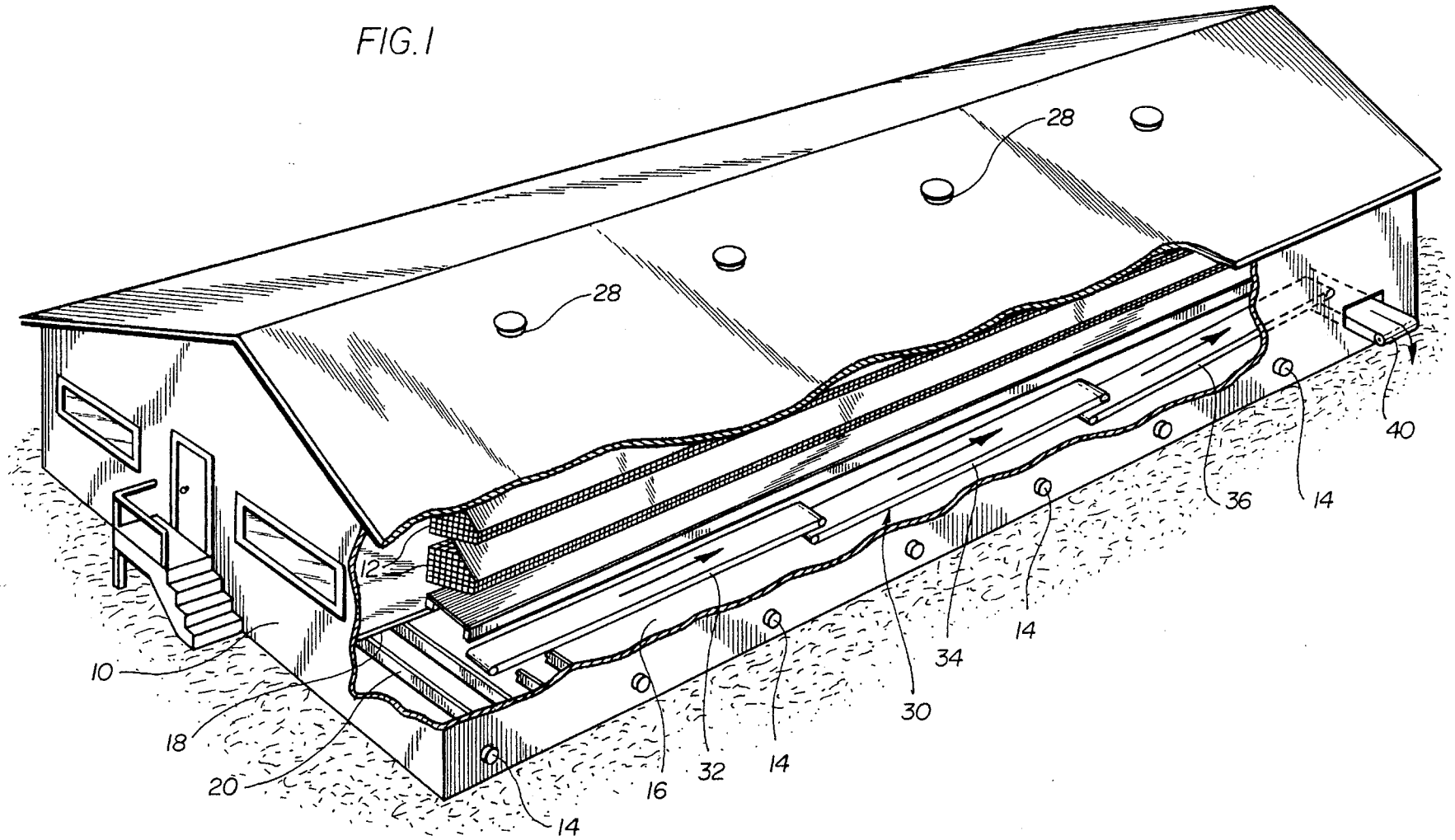
FIG. 1 is a perspective view of an animal confinement facility partially broken away to better illustrate certain components of the present invention.
Figure 2:
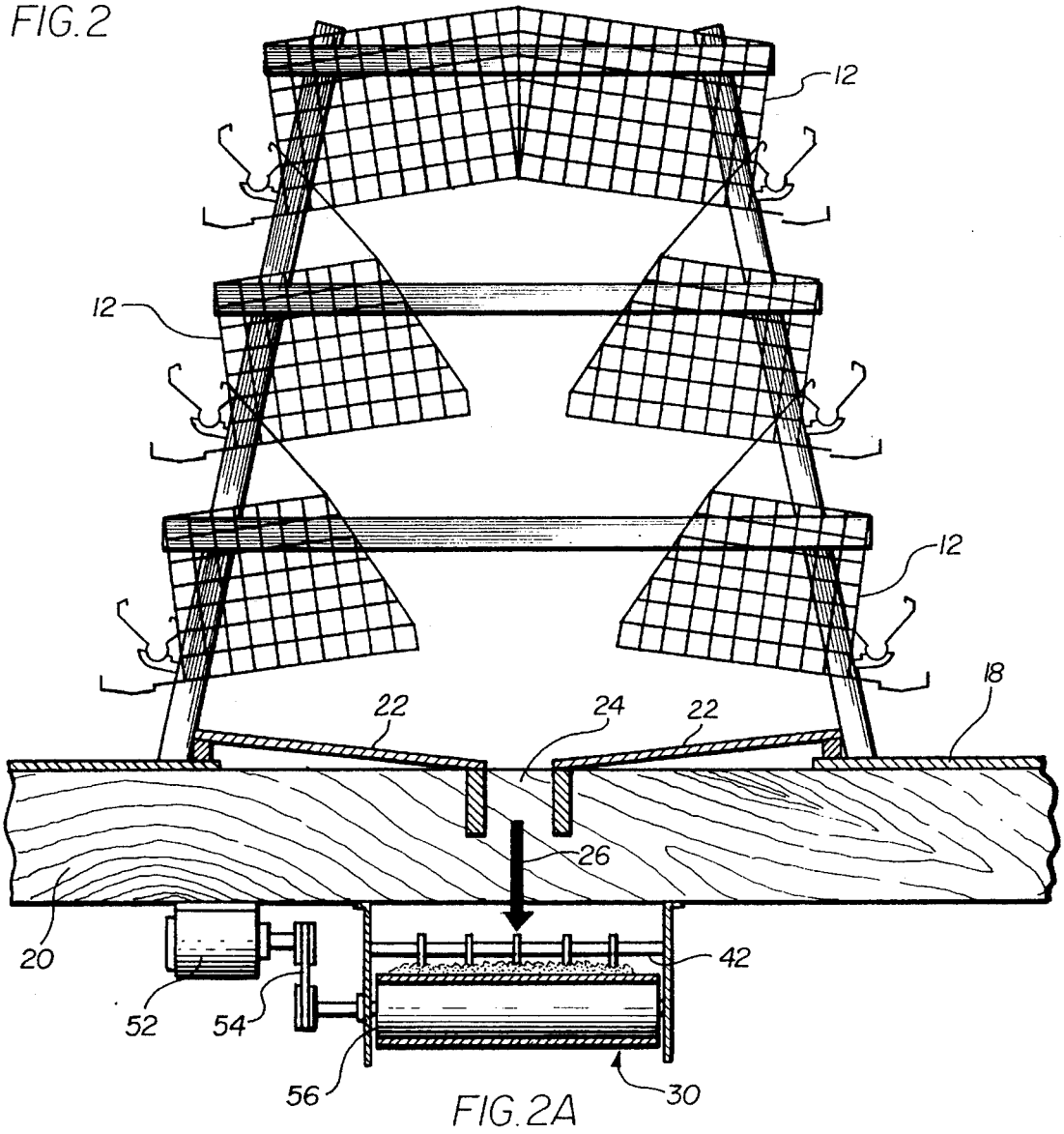
FIG. 2 is a side elevational view of the present invention shown in conjunction with a confinement cage arrangement located within an animal confinement facility, such as is shown in FIG. 1.

Turning to FIG. 1, there is shown an animal confinement facility 10 for housing animals which, for purposes of the present invention, can be of any practical dimensions or configuration. As partially illustrated in the broken-away portion of FIG. 1, such a confinement facility 10 typically includes an arrangement of confinement cages 12. Again, it should be understood that any practical configuration of cages can be used in the present invention, and the stacked arrangement, best shown in FIG. 2, is illustrated only as an example. Moreover, in most animal husbandry operations, a confinement facility 10 of the type shown houses several separate rows of cages 12 (eight rows, for example, in a building 80 to 90 feet wide) which can extend for several hundred feet in length.

One feature of the confinement facility 10 which is important to the present invention, however, is that it be well-ventilated. Adequate ventilation of the facility 10, as will become apparent below, is a necessary element in carrying out the present invention. The ventilation control apparatus disclosed and claimed in U.S. Pat. Nos. 5,097,749 and 5,145,460 (which are assigned to CTB, Inc. of Milford, Ind. as is the present application), for example, have been found to provide the requisite air flow and ability to control the direction of the air flow through the facility 10.

Briefly, the '749 and '460 patents (which are incorporated by reference herein) disclose and claim ventilation apparatus for use in a building. These apparatuses include input vents formed in an upper chamber of the buildings, output vents for removing air flow from central chambers in the buildings and fans located in lower chambers of the buildings, the operation of which exhausts air out of the buildings and influences the flow of air from the central chambers through the outlet vents and into the lower chambers. The '749 and '460 systems provide further control over the volumes of air flowing through the buildings with control apparatus to selectively meter the air flow exiting the upper chambers and entering the central chambers.

Figure 2A:
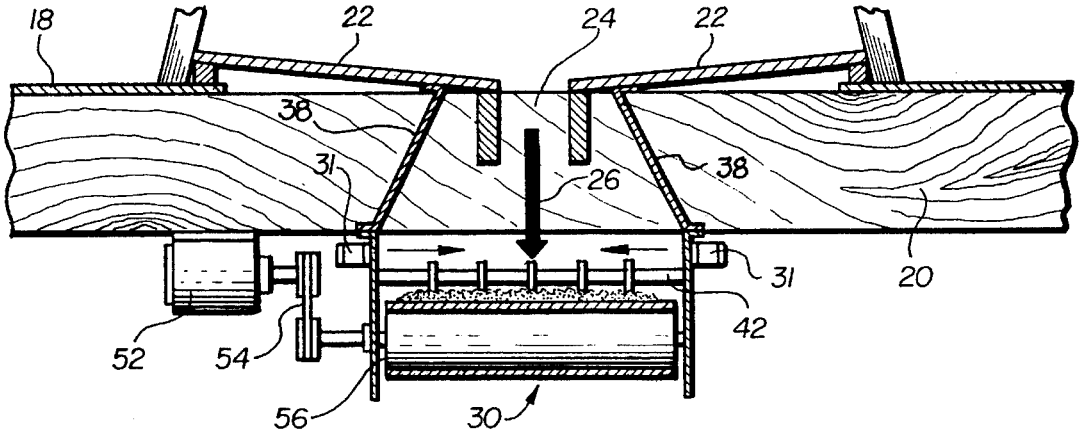
FIG. 2A is a modified embodiment of the apparatus shown in FIG. 2.

As stated above, while the specific apparatuses disclosed and claimed in the '749 and '460 patents are not needed to implement the present invention, it is necessary to provide adequate ventilation through the facility 10 and to control the direction of the ventilation. To this end, FIGS. 1–2A illustrate that the confinement facility 10 is equipped with exhaust fans 14 located in a pit or basement 16 of the facility 10 which is formed below a floor 18 supported by joists 20. Furthermore, the floor 18 is interrupted below each arrangement of confinement cages 12 and substantially replaced with one or more collection boards 22 separated by an open slot or channel 24 (FIGS. 2 and 2A), which can vary greatly in width. Accordingly, ventilation air 26 which enters the facility 10 through an inlet system (such as that disclosed in the '749 or '460 patents, or otherwise such as through simple roof inlets 28 as in FIG. 1) flows downward past the cages 12, through the open channel 24 between the collection boards 22, into the basement 16 and out of the exhaust fans 14. This provides the requisite flow and control over ventilation air 26 for operation of the present invention. If desired, increased air flow 26 can be provided by installing and operating attic fans (not shown) to direct additional air flow 26 downward through the animal confinement facility 10.

By way of illustration, the present invention will now be described in connection with a poultry operation wherein the birds are housed in individual cages within the A-frame arrangement 12 as best seen in FIG. 2. Manure deposited by the poultry flock falls by gravity onto the pair of collection boards 22 located beneath the lowest tier of the cage arrangement 12. Preferably, an automatic scraper assembly such as that disclosed and claimed in co-pending patent application Ser. No. 08/202,358, filed Feb. 28, 1994 (also assigned to CTB, Inc. of Milford, Ind.) is used in conjunction with the collection boards 22 to effectively direct the manure from the boards 22 onto an accumulating apparatus 30.

Typically, manure deposited in such an operation has a moisture content of between 60% and 70%. As noted above, a high moisture content results in handling, disposal and health problems such as difficulty in composting. Most modern composters used in the industry, for example, will not function properly if the moisture content of the manure exceeds 40%. Therefore, and in accordance with one of the principle aspects of the present invention, it is particularly advantageous to reduce the moisture content in the manure at this stage of the poultry operation by as much as 20% to 30% by use of the present invention.

Figure 3:
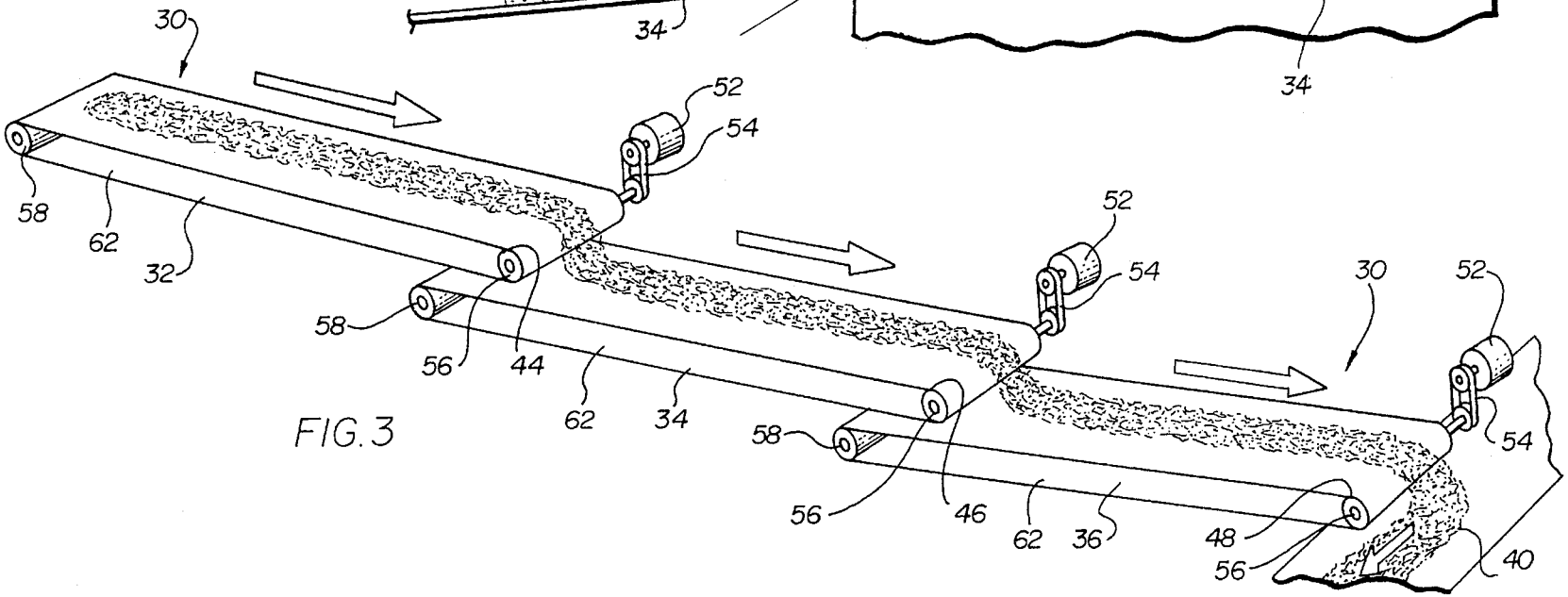
FIG. 3 is an isolated perspective view of an accumulation apparatus in the form of three end-to-end staggered belt conveyors.

More specifically, in a preferred embodiment of the present invention as best illustrated in FIGS. 1 and 3, the accumulating apparatus 30 takes the form of a series of belt conveyors 32, 34 and 36 located below the open channel 24 between the collection boards 22 in the basement 16 of the confinement facility 10. So located, the manure collected on the accumulating apparatus 30 is subjected to a downward flow of ventilation air 26 emerging from the open channel 24 formed between the collection boards 22, thereby significantly expediting the reduction of moisture from the manure. As noted above, the width of the open channel 24 can be varied to any practical width, but usually will range between 6 and 60 inches wide. Moreover, the open channel 24 can be designed to be adjustable over a range to quickly vary the width depending on the volume of air flow 26 directed through the facility 10.

The downward air flow 26 causes the demoisturization of the manure on the accumulating apparatus 30 and the humidification of the surrounding atmosphere in the basement 16. As shown in FIG. 2A, a modified embodiment of the invention also utilizes curtain members 38 to increase the volume of air flow directed onto the manure held by the accumulating apparatus 30, and thus increase the moisture reducing effect. In addition, conveyor fans 31, air tubes (not shown), or some other device can also be provided near the accumulating apparatus 30 to further supplement and control the air flow 26, if desired.

With respect to the use of multiple conveyor belts 32, 34 and 36 for the accumulating apparatus 30, although certainly not necessary in the practice of the present invention, several benefits are provided over alternate means. Firstly, drying the manure on a conveyor provides for ready removal when the desired moisture content reduction is achieved. Linking the conveyors 32, 34 and 36 with a cross conveyor 40 can also be easily accomplished to transport the dried manure out of the confinement facility 10 and into, for example, a customer's waiting truck.

Figure 5:
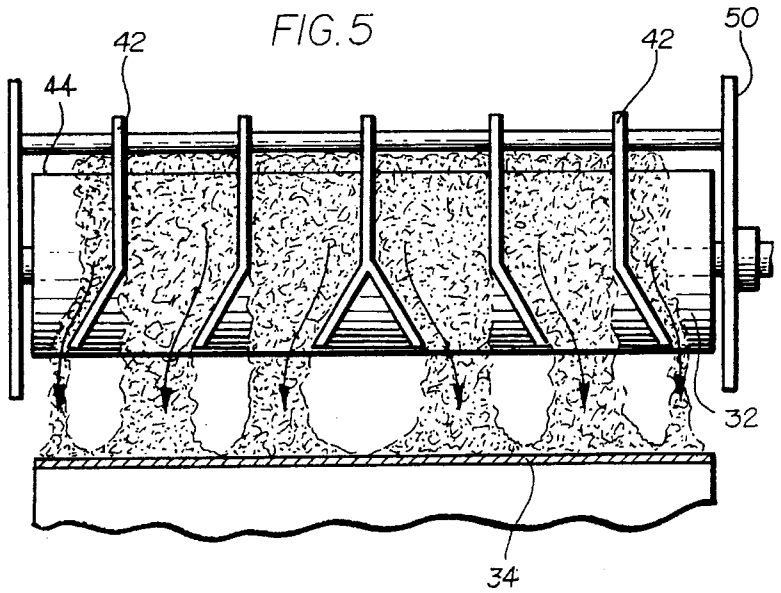
FIG. 5 is an isolated front end elevational view of the apparatus shown in FIG. 4.
Figure 4:
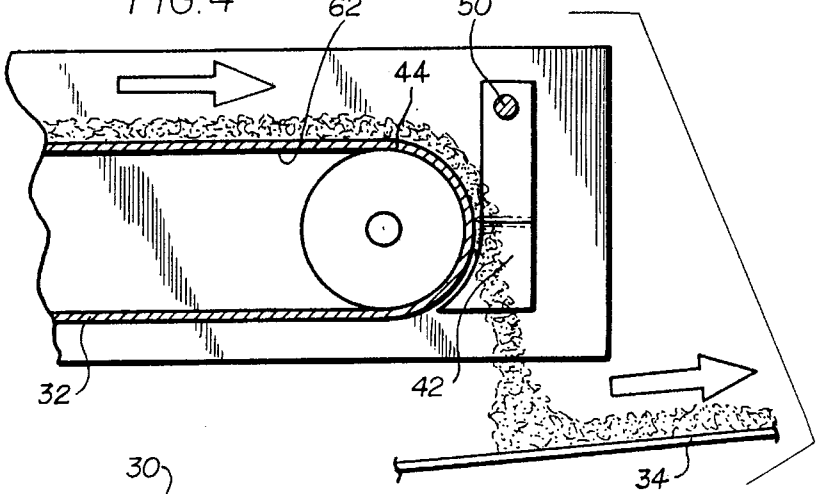
FIG. 4 is an isolated side elevational view of one end of one of the conveyors of FIG. 3 modified with a diverter component.

The use of multiple conveyors 32, 34 and 36, as compared to using a single conveyor, for the accumulating apparatus 30 provides the added flexibility of drying the manure in batches, and the capability of separating and turning the manure upon transfer from one conveyor to the next by use of a staggered, somewhat overlapped arrangement as shown in FIGS. 1 and 3, and/or the use of diverters 42 shown added to the system in the alternate embodiment illustrated by FIGS. 4 and 5. The diverters 42 are located slightly above the ends 44, 46 and 48 of the conveyor runs 32, 34 and 36, respectively, and can be pivotally mounted on a frame member 50 so as to pivot away from the ends 44, 46 and 48 of the conveyors while simultaneously separating and turning the manure encountered, as can easily be envisioned by reference to the drawings. The diverters 42 can take several forms, all of which are intended to fall within the scope of the invention.

It has also been found to be advantageous to form the conveyors 32, 34 and 36 from plastics, which facilitates installation and provides better corrosion resistance at approximately half of the cost. The conveyors 32, 34 and 36 can be located at any practical distance below the open channel 22 which, for example, may be a distance of approximately 12 inches.

Usually, manure is dried for a period of three days on the accumulating apparatus 30 before being transported out of the facility 10. The conveyors 32, 34 and 36 can be selectively driven in any of several known manners, such as by drivers 52, belts 54 and driven rollers 56. Return rollers 58 are used to guide the conveyors 32, 34 and 36 in the desired path.

Figure 6:
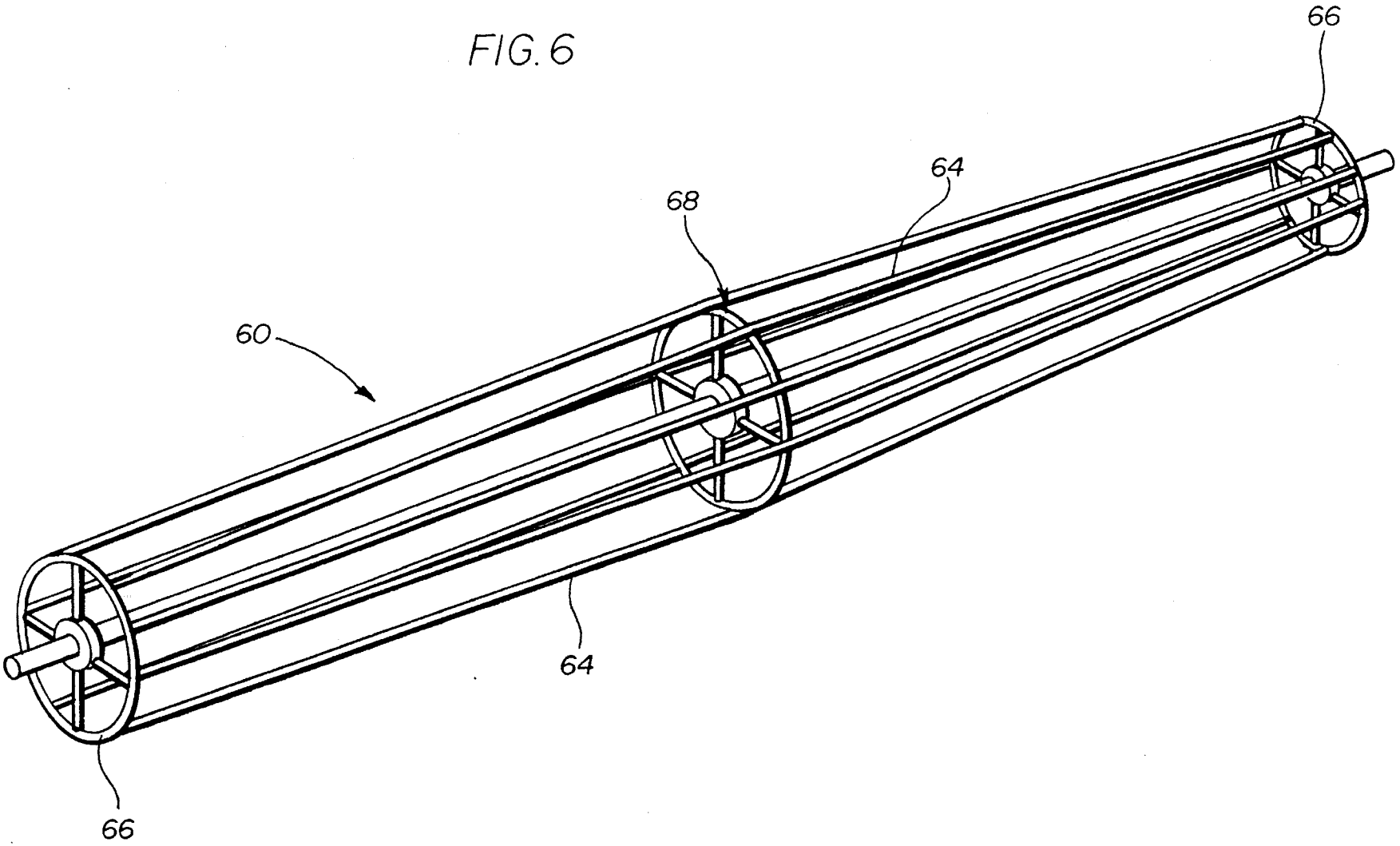
FIG. 6 is an isolated perspective view of a self-cleaning conveyor roller for use with the accumulation apparatus.

Ideally, the present invention further comprises the use of a self-cleaning return roller 60, as illustrated in FIG. 6, to prevent the manure build-up on inside surfaces 62 of the conveyors 32, 34 and 36. To this end, the return roller 60, as illustrated, is constructed of individual rod members 64, joined together to form a cylinder with retaining rings 66 at opposite ends, and is dimensioned to be approximately 2 inches wider, for example, than the width of the conveyors 32, 34 and 36 with which it is utilized. In operation, the individual circumferentially-spaced rod members 64 of the self-cleaning return roller 60 causes manure on the inside surfaces to be knocked off and to "walk" outward along the return roller 60 and fall out of the conveyors 32, 34 and 36, near the retaining rings 66, into the pit 16.

It should be understood, however, that another design, such as a solid-core roller with circumferentially-spaced, raised ribs or circumferentially-spaced grooves formed therein, could also function in like manner to dislodge the build-up of manure, and clean the interior surfaces of the conveyors 32, 34 and 36 as described above.

A preferred form of the self-cleaning return roller 60 is crowned such that it includes a slight taper extending from a mid-width apex 68, in each direction, to the retaining rings 66. The taper would be expected to be in the range of 2°–3° relative to the horizontal axis of the return roller 60 in order to best promote material flow, such as dislodged manure, dust or other debris. Other angles, however, could be used and still fall within the scope of the invention.

A preferred method of practicing the present invention includes providing a ventilated confinement facility 10 having apparatus 30 for accumulating manure deposited by animals located within the facility 10. Ventilation air 26 is channelled and directed over the manure accumulated on the apparatus 30 until the desired reduction in the moisture content of the manure is achieved.

The invention is claimed as follows:

1. A manure drying system for reducing the moisture content in animal manure, said drying system comprising:

a. an animal confinement facility having a ventilation system causing an air flow within the facility;

b. accumulation means for collecting and selectively holding manure produced by animals within the facility, and;

c. channeling means for concentrating and directing a portion of the air flow produced within the facility onto the manure collected by the accumulation apparatus to substantially dry said manure.

2. A manure drying system as recited in claim 1, further comprising an arrangement of animal cages located inside of the confinement facility for containing an area within which animal manure will be produced.

3. A manure drying system as recited in claim 2, further comprising at least one manure collection board located beneath said arrangement of animal cages for temporarily collecting the animal manure deposited from the cages and allowing the manure to be directed onto said accumulation means.

4. A manure drying system as recited in claim 3, wherein a pair of collection boards is located beneath the arrangement of animal cages, and the manure collected on the collection boards is directed onto the accumulation apparatus through an open-channel formed between the pair of collection boards.

5. The manure drying system as recited in claim 4, wherein the open-channel formed between the pair of collection boards comprises said channeling means for directing said concentrated portion of the air flow produced within the facility onto the manure collected by the accumulation means to substantially dry said manure.

6. The manure drying system as recited in claim 5, wherein the accumulation means comprises a selectively operable belt conveyor located below the open-channel for holding or transporting the animal manure.

7. The manure drying system as recited in claim 6, further comprising at least one curtain operatively associated with the open-channel for concentrating the air flow produced by the ventilation system within the facility onto the manure deposited on the belt conveyor.

8. The manure drying system as recited in claim 5, wherein the accumulation means comprises a plurality of selectively operable belt conveyors, situated in an end-to-end arrangement, located below the open-channel for holding or transporting the animal manure.

9. The manure drying system as recited in claim 8, wherein, in the end-to-end arrangement, the belt conveyors somewhat overlap each other and further comprising at least one diverter in operative association with said belt conveyors for breaking apart the manure during transfer of the manure from one conveyor to the next.

10. A method for reducing the moisture content in animal manure comprising the steps of:

a. providing an animal confinement facility for housing animals;

b. supplying a ventilating air flow within said animal confinement facility;

c. providing accumulating apparatus for collecting and holding manure deposited within the confinement facility by the animals, and;

d. concentrating and channeling a portion of the ventilating air flow over the accumulating apparatus to cause a significant reduction in the moisture content of the manure collected and held by the accumulating apparatus.

11. A method for reducing the moisture content in animal manure as recited in claim 10, further comprising providing an arrangement of animal cages to limit the area within the facility where animal manure is deposited.

12. A method for reducing the moisture content in animal manure as recited in claim 11, further comprising the step of providing at least one collection board disposed beneath the cage arrangement for temporarily accumulating manure and facilitating a transfer of manure onto the accumulating apparatus.

13. A method of reducing the moisture content in animal manure as recited in claim 12, further comprising the step of providing at least two belt conveyors located in an end-to-end arrangement below the collection boards for accumulating the deposited manure.

14. A method for reducing the moisture content in animal manure as recited in claim 13, further comprising the step of somewhat overlapping each of the multiple conveyors with respect to the next in said end-to-end arrangement and providing diverters located in operative association with at least one of the conveyors for breaking apart and turning the manure deposited on said conveyors upon transfer of the manure from one conveyor to the next.

15. A manure drying system for reducing the moisture content in animal manure, said drying system comprising:

a. an animal confinement facility having a ventilation system causing an air flow within the facility;

b. accumulation means for receiving and selectively holding manure produced by animals within the facility;

c. collecting means for temporarily collecting wet manure produced by animals within the facility, and;

d. channeling means for directing said manure from said collecting means onto said accumulation means while said manure is substantially wet, said accumulation means receiving said substantially wet manure, said channelling means directing a portion of the air flow produced by said ventilation system onto the substantially wet manure received by the accumulation means to substantially dry said manure.

16. A manure drying system as recited in claim 15, further including an arrangement of animal cages located inside of the confinement facility for containing an area within which animal manure will be produced and wherein said collecting means comprises at least one manure collection board located beneath said arrangement of animal cages for temporarily collecting the animal manure deposited from the cages and allowing the substantially wet manure to be directed onto said accumulation means.

17. The manure drying system as recited in claim 16, wherein a pair of collection boards is located beneath the arrangement of animal cages, and the manure collected on the collection boards is directed onto the accumulation means through an open-channel formed between the pair of boards, said open-channel comprises said channeling means for directing said portion of the air flow produced by the ventilation system onto the substantially wet manure collected by the accumulation means to substantially dry said manure.

18. The manure drying system as recited in claim 17, further comprising at least one curtain operatively associated with the open-channel for more directly channeling a portion or all of the air flow produced by the ventilation system within the facility onto the manure deposited on the accumulation means to substantially dry said manure.

19. A method for reducing the moisture content in animal manure comprising the steps of:

a. providing an animal confinement facility for housing animals;

b. supplying a ventilating air flow within said animal confinement facility;

c. providing accumulating means for receiving and selectively holding manure deposited within the confinement facility by the animals;

d. providing collecting means for temporarily collecting wet manure produced by the animals within the facility;

e. providing a channeling means for allowing said manure to pass from said collecting means to said accumulating means;

f. transferring said manure from said collecting means onto said accumulation means while said manure is substantially wet, and;

g. channeling a sufficient volume of the ventilating air flow over the accumulating means to cause a significant reduction in the moisture content of the manure received by the accumulating means from the collecting means.

20. A method for reducing the moisture content in animal manure as recited in claim 19, further comprising providing an arrangement of animal cages to limit the area within the facility where animal manure is deposited and wherein the step of providing said collecting means comprises providing at least one collection board disposed beneath the cage arrangement for temporarily accumulating manure and facilitating a transfer of manure onto the accumulating means while said manure is substantially wet.

* * * * *